United States Patent [19]

Morita et al.

[11] 4,177,788

[45] Dec. 11, 1979

[54] DIESEL ENGINE FUEL CONTROL APPARATUS

[75] Inventors: Yoshiyuki Morita, Kariya; Masami Itou, Toyota; Shigeyoshi Nomura, Aichi; Masahiro Ueda, Toyota, all of Japan

[73] Assignees: Nippondenso Co., Ltd., Kairya; Toyota Jidosha Kogyo Kabushiki Kaisha, Toyota, both of Japan

[21] Appl. No.: 935,723

[22] Filed: Aug. 21, 1978

[30] Foreign Application Priority Data

Jan. 11, 1978 [JP] Japan ..... 53-2256

[51] Int. Cl.[2] ..... F02D 31/00; F02D 1/00

[52] U.S. Cl. ..... 123/97 B; 123/102; 123/139 DE; 123/179 L; 123/179 B; 123/DIG. 11; 123/139 ST

[58] Field of Search ..... 123/97 B, 102, 139 DE, 123/139 ST, 139 AZ, 179 L, 179 B, 198 DB, DIG. 11

[56] References Cited

U.S. PATENT DOCUMENTS

| | | | |
|---|---|---|---|
| 2,470,382 | 5/1949 | Vanni | 123/139 DE |
| 3,089,475 | 5/1963 | Kohler et al. | 123/139 ST |
| 3,736,910 | 6/1973 | Raff | 123/97 B |
| 3,771,505 | 11/1973 | Taplin | 123/97 B |
| 3,943,892 | 3/1976 | Brinkman | 123/139 DE |
| 4,062,332 | 12/1977 | Perr | 123/97 B |

*Primary Examiner*—Ira S. Lazarus

*Attorney, Agent, or Firm*—Cushman, Darby & Cushman

[57] ABSTRACT

A diesel engine fuel control apparatus is disclosed wherein a control unit for controlling the amount of the supply of fuel by a key switch which selectively connects a start position terminal, a normal position terminal and an interruption position terminal to a power supply, includes a control lever position sensing switching means for controlling a fuel injection pump and switchover means which are connected to at least the start position terminal and the normal position terminal, respectively, to control the energization of an actuator of a pump control lever, and a normally closed switching means which is turned off when an exhaust brake is applied is connected between said normal position terminal and one of said switching means.

4 Claims, 10 Drawing Figures

FIG.3
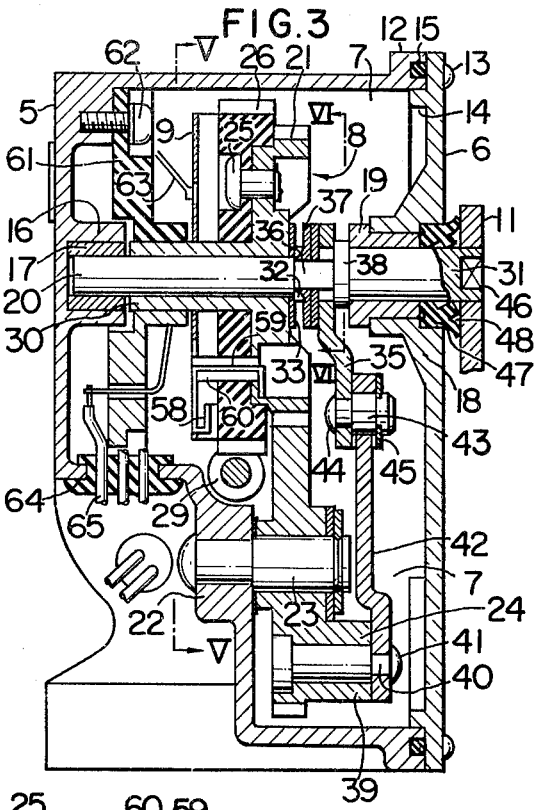
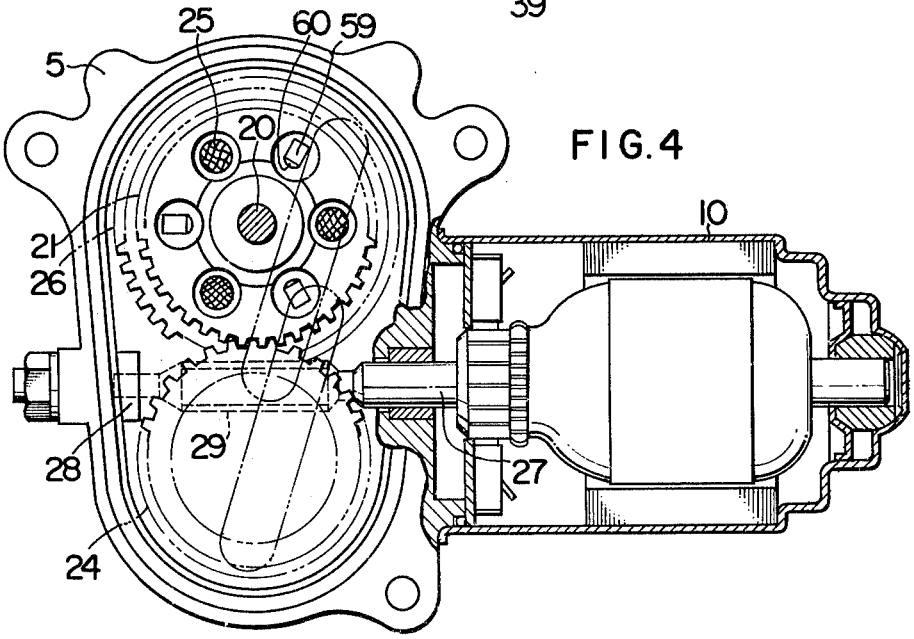
FIG.4

DIESEL ENGINE FUEL CONTROL APPARATUS

BACKGROUND OF THE INVENTION

1. Field of the Invention

The present invention relates to an apparatus which controls a control lever means in an injection pump of a diesel engine by the actuation of an engine key switch to start and stop the engine and which interrupts the supply of fuel during exhaust braking operation to save the fuel and prevent black smoke from being ejected when the brake is released.

2. Description of the Prior Art

It has been known to increase the amount of fuel at the start of a diesel engine by a solenoid adapted to be energized by the actuation of a key switch, but it has been impossible to stop the engine by the deactuation of the key switch and hence a cable connected to a control lever means is extended to a driving position so that it is manually pulled to stop the engine. It has also been known to pull a decrease lever by a solenoid when the exhuast brake is operated, in order to decrease the amount of fuel supply.

When those apparatus are combined together, two solenoids are required and a circuit configuration is complex.

SUMMARY OF THE INVENTION

It is an object of the present invention to provide a diesel engine fuel control apparatus which can perform a function of automatically interrupting the supply of fuel when an exhaust brake is operated, wherein a normally closed switching means which is adapted to be automatically turned off or opened when the exhaust brake is operated is inserted in a signal line connecting an operating position terminal of a key switch and a switchover means of the control apparatus so that when the exhaust brake is operated the switchover means is forcibly controlled by the normally closed switching means irrespective of the position of the key switch.

BRIEF DESCRIPTION OF THE DRAWINGS

FIGS. 1 through 8 show one embodiment of the present apparatus, in which:

FIG. 1 is a schematic front view showing in use a state;

FIG. 2 is a schematic front view of an actuator shown in FIG. 1;

FIG. 3 is a sectional view taken along an arrowed line III—III in FIG. 2;

FIG. 4 is a fragmentary front view showing a structure related to a mechanical construction of the actuator;

FIG. 5 is a sectional view taken along an arrowed line V—V in FIG. 3;

FIG. 6 is a sectional view taken along an arrowed line VI—VI in FIG. 3;

FIG. 8 is an electrical circuit diagram of one embodiment of the present apparatus.

DESCRIPTION OF THE PREFERRED EMBODIMENTS

Figure 1:
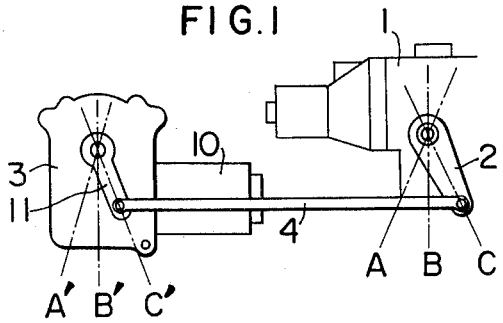

Referring to the drawings, one embodiment of the present apparatus is explained in detail. In FIG. 1, an injection pump 1 increases or decreases the amount of the injected fuel in accordance with a rotational position of a control lever means 2. A leftmost postion A is a starting increase position, a position B is a normal position and a rightmost position C is a fuel supply interrupting position. Numeral 3 denotes an actuator which responds to the actuation of a key switch, not shown, to rotate the control lever means 2 to one of the positions A, B and C through a link 4.

As shown in FIGS. 2 through 5, the actuator 3 accommodates a mechanical structure 8 and a pattern switch 9 including a position sensing means which constitutes a part of an electrical circuit, in a closed chamber 7 formed by a case 5 and a cover 6, and the actuator 3 drives the mechanical structure 8 by a D.C. motor 10 mounted on an exterior of the case 5 to rotate an output lever 11 which projects outward from the cover 6.

The cover 6 is fixed to a flange 12 of the case 5 by bolts 13 and a projecting edge 14 of the cover fits to an inner periphery of the case 5 to positively maintain the fixed position to the case 5. Numeral 15 denotes a packing seal.

The mechanical structure 8 comprises a rotary shaft 20 supported by a bearing metal 17 mounted in a ring projection 16 at the bottom of the case 5 and a metal bearing 19 mounted on a projection 18 inside the cover 6, a gear 21 rotatably mounted on said shaft 20, a stationary shaft 23 having one end thereof fixed to an upper bottom 22 of a stepped bottom of the case 5, in parallel with the rotary shaft 20, a gear 24 rotatably mounted on the shaft 23 and adapted to mesh with the gear 21 and having the same diameter as the gear 21, and a worm wheel 26 made of a wear resistant and hard insulating material such as tefron and affixed to the gear 21 by a rivet 25.

A rotary shaft 27 (FIG. 4) of the motor 10 transverses the shaft 20 and extends into a case 5, and an extended end thereof is supported by a bearing 28 which is mounted in a case 5 and a worm gear 29 mounted on the extended portion meshes with the worm wheel 26.

Figure 6:
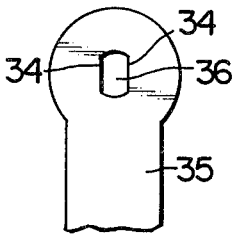

The rotary shaft 20 has a step 32 between a smaller diameter portion which extends through a boss 30 which extends lengthwise of the gear 21 and a larger diameter portion 31 which extends through the metal bearing 19. A washer 33 abutting against the step 32 and the metal bearing 17 prevent the axial movement of the gear 21. As shown in FIG. 6, a pair of planar portions 34 are formed in the larger diameter portion 31 near the step 32 to provide a flat axial cross section. On the other hand, there is formed a bore at an end of an arm 35 for receiving the flattened shaft portion 36. The shaft portion 36 extends through the bore to transmit a rotational force from the arm 35 to the rotary shaft 20. A spring washer 37 serves to urge the arm 35 to a flange 38 formed on the larger diameter portion 31 to prevent the axial movement of the arm 35, and the flange 38 abuts against the metal bearing 19 to prevent the outward movement of the rotary shaft 20.

An end of a link 42 is coupled to the axial projection 39 formed on the gear 24 by a pin 40 and a bolt 41, and a base 44 of a pin 43 is securely mounted to the other end of the link 42 by a snup ring 45, and the arm 35 and the link 42 are interlinked by the pin 43 and a bolt 44.

The rotary shaft 20 projects outward from the cover 6 and is formed with the planar portions 46 at the outer end thereof to provide the flat cross section, and the other end is pressed into the bore formed in the output lever 11 and having the same shape as the cross section of the rotary shaft, to fix the output lever 11 to the rotary shaft 20. A ring recess 47 formed in the cover 6 is filled with a packing 48 which is pressed by the output lever 11 to seal the chamber 7.

Figure 7A:
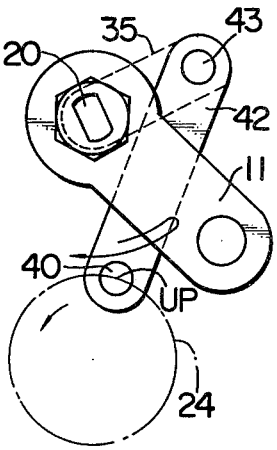
FIGS. 7A, 7B and 7C illustrate the operation of a link mechanism in the actuator.
Figure 7B:
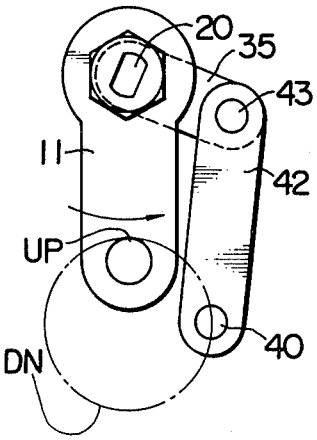
Figure 7C:
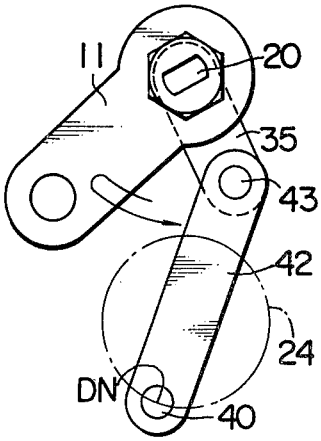

With the construction described above, the rotation of the gear 24 reciprocally pivots the output lever 11 through the arm 35 and the link 42. In order to reverse the direction of pivotal movement of the output lever 11 when the pin 40 passes through a bottom dead center DN as shown in FIG. 7C, the lengths of the arm 35 and the link 42 are chosen such that they bend towards each other at the bottom dead center DN. A symbol UP denotes a top dead center. As the gear 24 rotates, the output lever 11 reciprocally pivots within a given angle to pivot the control lever means 2 between the starting increase position A and the fuel supply interrupting position C, as described above.

Figure 8:
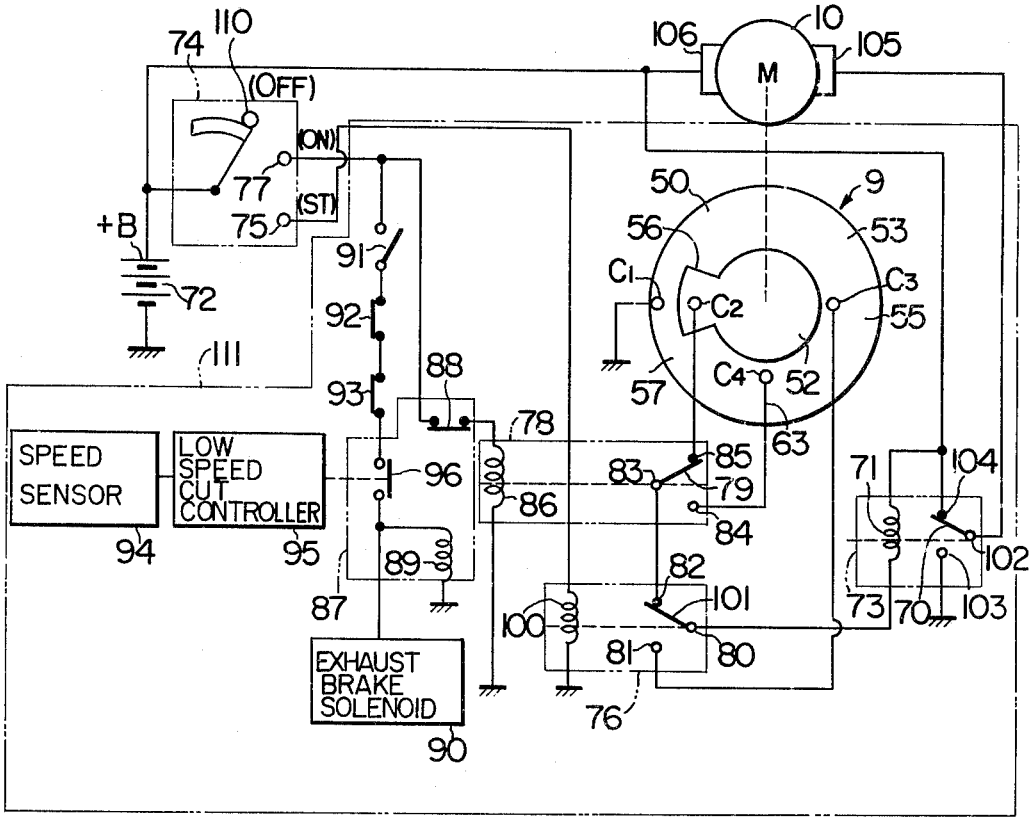

A rotary contact 50 of the position sensing switching means 9 is fixed to the worm wheel 26. As shown in FIG. 8, the rotary contact 50 includes an electrically conductive plate 53 which has a ring portion 55. A projection 56 (insulator) which radially projects from the inner circumference of the ring portion 55 is formed on an inner insulator plate 52, and a narrow portion 57 is formed in the conductive plate 53 to face the projection 56.

The conductive plate 53 may be fixed to the worm wheel 26 by an suitable means. In the fixing means for the conductive plates 53 illustrated in FIG. 3, three short legs 58 and three long legs 59 are formed integrally with the interior and the exterior of the ring portion 55, with the short legs being bent inward to abut against the worm wheel 26 while the long legs 59 extending through bores 60 formed in the worm wheel 26 and the ends of the long legs being bent over the back side of the worm wheel 26.

Figure 2:
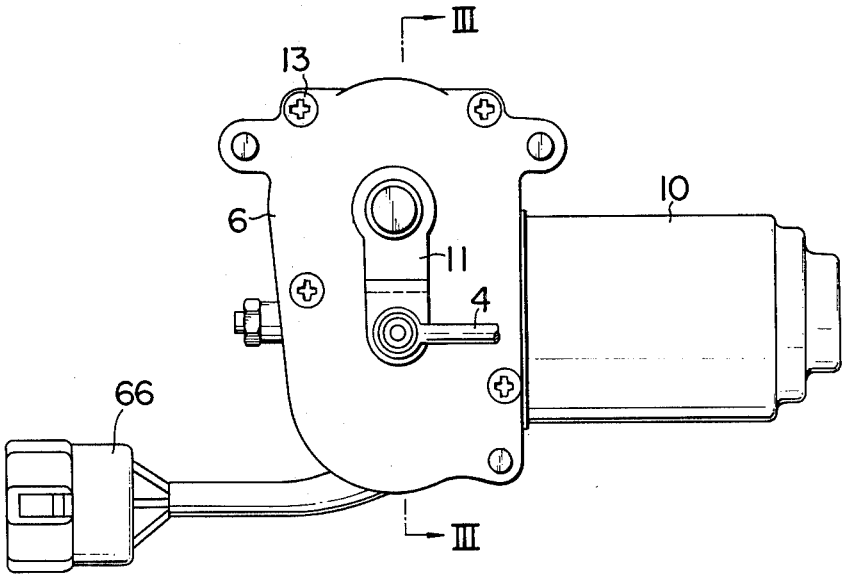
Figure 5:
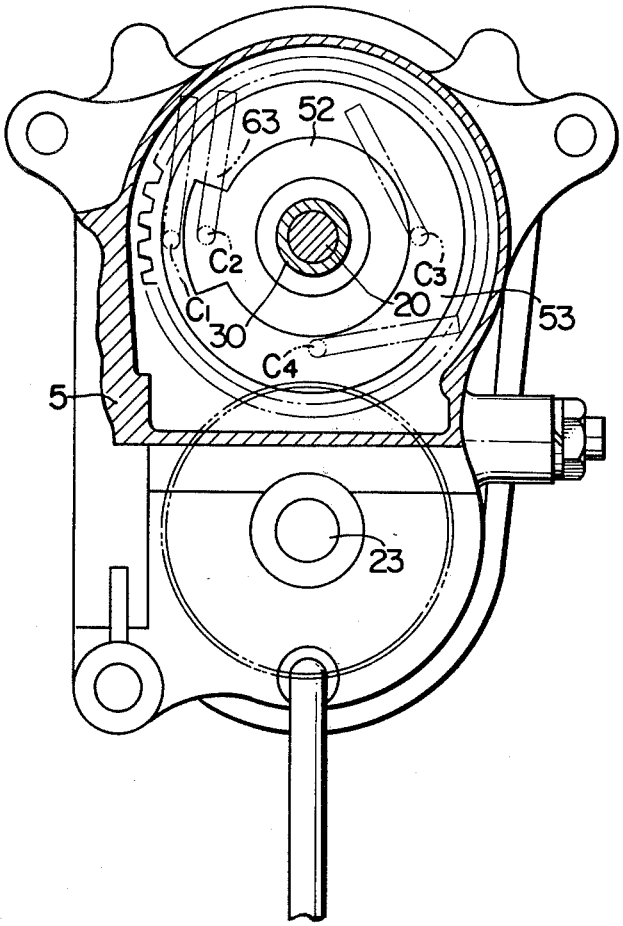

An insulating plate 61 through which the rotary shaft 20 extends is fixed to the case 5 by a bolt 62, and first ends of four contact members 63 made of resilient metal are fixed to the insulating plate 61 while the other ends are urged to the rotary contact 50 to constitute the position sensing switching means 9 having four contacts C1-C4. The contact members 63 are connected to an external electrical circuit by lead wires 65 (FIG. 3) which hermetially extend through a rubber bush 64 and a connector 66 (FIG. 2).

In the electrical circuit shown in FIG. 8, the position sensing switching means 9 which is integral with the output lever 11 is circular and has the projection 56. Of the four contacts which are slid by the position sensing switching means 9, the contact C1 continuously supplies ground potential to the ring portion 55. The contact C2 contacts with the projection 56 of the position sensing switching means 9 when the output lever 11 reaches a position C', that is, the fuel supply interrupting position. The contact C3 contacts with the projection 56 when the output lever 11 reaches a position A', that is, the fuel supply increasing position. The contact C4 contacts with the projection 56 when the output lever 11 reaches a position B', that is, the normal fuel supply position.

One terminal of the motor 10 is constantly connected to a positive terminal of a vehicle-mounted power supply 72, that is, it is constantly fed with +B, and the other terminal is normally connected to +B by a relay contact 70 and it is grounded when a relay coil 71 is excited. One terminal of the relay coil 71 of a relay which has the relay contact 70 is constantly fed with +B while the other terminal of the relay coil 71 is connected to the contacts C2 and C4 through a relay 76 which is excited through a start position terminal 75 when the key switch 74 is at a start position (ST), and through a contact 79 of a relay 78 which is excited through a normal position terminal 77 when the key switch 74 is at a normal position (ON). More particularly, the relay coil 71 is connected to a common contact 80 of the relay 76. A contact 81 which is normally open to the contact 80 is connected to the contact C3 while a contact 82 which is normally closed to the contact 80 is connected to a common contact 83 of the relay 78. A contact 84 which is normally open to the contact 83 is connected to the contact C4 while a contact 85 which is normally closed to the contact 83 is connected to the contact C2.

The relay coil 86 is energized through the key switch 74 and the normally closed contact 88 which is connected in series with the key switch 74 and forms the normally closed switching means for an exhaust brake relay 87, a coil 89 of which is connected in parallel with an exhaust brake solenoid 90.

The exhaust brake solenoid 90 is energized through a series circuit of an exhaust brake main switch 91, an accelerator switch 92, a clutch switch 93 and a relay contact 96 which is actuated through a low speed cut controller 95 which activates the exhaust brake when a signal from a speed sensor 94 exceeds a predetermined level.

The operation of the configuration described above is now explained. When the key switch 74 is rotated to the start position (ST) to start the engine, a relay coil 100 is energized so that a contact member 101 shorts the contacts 81 and 80. As a result, a circuit from the +B power supply through the relay coil 71, the relay contact 80, the relay contact 81, the contact C3, the position sensing switching means 9, the contact C1 to ground is completed. On the other hand, the relay contact member 70 shorts the contacts 102 and 103 so that a circuit from the +B power supply through the motor 10, the relay contact 102, the relay contact 103 to ground is completed and the motor 10 is energized.

As the output lever 11 rotates to the position A' so that the contact C3 rides on the projection 56 of the position sensing switching means 9 which is moved with the output lever 11, the relay coil 71 is deenergized. As a result, the relay contact member 70 shorts the contacts 102 and 104 so that an electrical brake circuit from an input terminal 105 of the motor 10, the relay contact 102, the relay contact 104 to an input terminal 106 of the motor 10 is completed and the motor 10 is rapidly stopped. Since the control lever means 2 of the injection pump 1 is at the fuel supply increasing position A and a starting cell is rotated at this time, the engine can be readily started.

When the key switch 74 is returned to the normal position (ON) after the engine has been started, the relay coil 86 is energized and the contact member 79 shorts the contacts 83 and 84. As a result, a circuit from the +B power supply through the relay coil 71, the relay contact 80, the relay contact 82, the relay contact 83, the relay contact 84, the contact C4, the position sensing switching means 9, the contact C1 to ground is completed, and the relay contact member 70 shorts the contacts 102 and 103 like in the above case so that the motor 10 rotates. As the output lever 11 of the actuator 3 rotates to the position B' so that the position sensing switching means cuts off current supply through the contact C4, the motor 10 is stopped by the electrical brake as in the previous case. Since the control lever means 2 is at the normal fuel supply position B at this time, the engine rotates normally.

When the key switch 74 is returned to the OFF position to stop the engine, the relay coil 86 is deenergized and the contact 83 is disconnected from the contact 84. As a result, a circuit from the +B through the relay coil 71, the relay contact 80, the relay contact 82, the relay contact 83, the relay contact 85, the contact C2, the position sensing switching means 9, the contact C1 to ground is completed, and the relay contact member 70 contacts with the contacts 102 and 103 so that the motor 10 is rotated. As the output lever 11 rotates to the position C' so that the position sensing switching means 9 cuts off current supply through the contact C2, the motor 10 is stopped by the electrical brake as in the previous case. The control lever means 2 is at the fuel supply interrupting position C at this time and hence the engine is stopped.

The operation when the exhaust brake is operated during the operation of the engine is now explained. During the operation of the engine, the output lever 11 is at the position B' and the relay coil 86 is being energized. When the exhaust brake is operated under this condition, the relay coil 89 of the exhaust brake relay 87 is energized and the normally closed contact 88 is opened to deenergize the relay coil 86. The relay contact 83 contacts with the relay contact 85 and the output lever 11 of the actuator 3 rotates to the position C' and stops thereat, like in the previous case. As a result, the control lever means 2 is driven to the position C so that the supply of fuel to the engine is blocked.

The key switch 74 has at least the start position terminal 75, the normal position terminal 77 and the interrupting position terminal 110 corresponding to the OFF position, and it may be constituted by a relay energized through a switch which is manually operated by a driver. The actuator 3 may be one which includes a reversible motor.

Furthermore, the switch over means 76 and 78 and the normally closed switching means 88 may be constructed by semiconductor devices instead of the relays. In the illustrated embodiment, the control apparatus is shown by a block 111 encircled by a chain line.

As described hereinabove, according to the present invention, since the amount of supply of fuel to the injection pump can be automatically controlled in accordance with the operation of the key switch and the supply of fuel to the diesel engine is blocked by automatically controlling the injection pump by a simple circuit configuration when the exhaust brake is operated, the fuel can be saved and the ejection of black smoke when the exhaust brake is released can be prevented.

We claim:

1. A diesel engine fuel control apparatus comprising:

a key switch having operational positions including at least a start position for starting a diesel engine, an operation position for continuously running the engine and an interruption position for stopping the engine, said key switch having a start position terminal, an operation position terminal and an interruption position terminal which are selectively connected to one terminal of a vehicle-mounted power supply depending on said key switch being at said start position, said operation position or said interruption position;

an injection pump for controlling the amount of fuel supplied to said diesel engine;

an electrical actuator for driving a control lever means of said injection pump to control the amount of fuel supplied to said diesel engine;

a control unit for controlling the energization of said electrical actuator to increase or decrease the amount of fuel supplied to said diesel engine from said injection pump in accordance with the operational position of said key switch, said control unit including;

a position sensing switching means for sensing the position of said control lever means of said injection pump;

a switchover means adapted to be turned on and off by signals from the start position terminal and the operation position terminal of said key switch, said switchover means being connected to said position sensing switching means and said electrical actuator to drive said electrical actuator to a predetermined position in response to a control signal from said key switch;

a brake responsive switching means for forcibly controlling said switchover means irrespective of the control signal from said operation position terminal of said key switch when an exhaust brake is applied to said diesel engine, for substantially blocking the supply of fuel to said diesel engine from said injection pump;

whereby the operation of said injection pump is controlled by said key switch and an excessive amount of supply of fuel is prevented when the exhaust brake is applied.

2. A diesel engine fuel control apparatus according to claim 1, wherein said brake responsive switching means comprises a normally closed switching means connected between said operation position terminal of said key switch and said switchover means.

3. A diesel engine fuel control apparatus according to claim 1, wherein said electrical actuator comprises a motor, said position sensing switching means comprises a rotary switch at least including a conductor adapted to be driven by an output shaft of said motor and arranged in a pattern on a rotary plate, and a brush adapted to be intermittently brought into sliding contact with said conductor, and said switchover means comprises a relay having a coil energized by a current from said key switch.

4. A diesel engine fuel control apparatus according to claim 3, wherein said brake responsive switching means comprises a normally closed relay contact connected between said operation position terminal of said key switch and the coil of said switchover means.

* * * * *